US005138329A

United States Patent [19]

Saarnimo et al.

[11] Patent Number: 5,138,329

[45] Date of Patent: Aug. 11, 1992

[54] ANTENNA SWITCH

[75] Inventors: Timo Saarnimo, Salo; Ari Léman, Pertteli, both of Finland

[73] Assignee: Nokia Mobile Phones Ltd., Salo, Finland

[21] Appl. No.: 674,526

[22] Filed: Mar. 22, 1991

[30] Foreign Application Priority Data

Apr. 12, 1990 [FI] Finland ..... 901890

[51] Int. Cl.[5] ..... H01Q 1/24

[52] U.S. Cl. ..... 343/702; 343/893

[58] Field of Search ..... 343/702, 901, 876, 893

[56] References Cited

U.S. PATENT DOCUMENTS

| | | | |
|---|---|---|---|
| 3,087,117 | 4/1963 | Mitchell | 343/702 |
| 3,969,728 | 7/1976 | Hodsdon et al. | 343/702 |
| 4,860,024 | 8/1989 | Egashira | 343/702 |
| 4,862,182 | 8/1989 | Egashira | 343/702 |
| 4,920,352 | 4/1990 | Martensson et al. | 343/702 |
| 4,989,012 | 1/1991 | Martensson et al. | 343/702 |

FOREIGN PATENT DOCUMENTS 2219911 12/1989 United Kingdom .

*Primary Examiner*—Michael C. Wimer
*Assistant Examiner*—Hoanganh Le
*Attorney, Agent, or Firm*—Darby & Darby

[57] ABSTRACT

The invention relates to an antenna switch for radio telephones, which are provided with an extendible external antenna (1) and a built-in internal antenna (2). The antenna switch comprises a microswitch (4) having a switch arm (6) and a press switch (5). The antenna switch accomplishes the switching-on of the microswitch (4), whereupon the signal route is connected with the internal antenna (2). Respectively, when the external antenna (1) is moved in the reverse direction, the signal route is connected with the external antenna (1). The switch arm (6) is in direct contact with the external antenna (1) so that the contact accomplishes the switching-on of the microswitch (4), when the external antenna (1) is in a partly pushed-in position. The switch arm (6) is situated in close vicinity to the lowest part (15) of the external antenna (1) when the external antenna (1) is in its extended extreme position.

13 Claims, 1 Drawing Sheet

ANTENNA SWITCH

BACKGROUND OF THE INVENTION

1. Field of the Invention

The invention relates to an antenna switch for telephones, which are provided with an extendible external antenna and a built-in internal antenna, which antenna switch comprises a microswitch having a switch arm and a press switch, and which antenna switch is arranged to accomplish the switching-on of the microswitch, whereupon the signal route is connected with the internal antenna, when the external antenna is moved from the extended position to the pushed-in position, and, respectively, to release the switching-on of the microswitch, whereupon the signal route is connected with the external antenna, when the external antenna is moved in the reverse direction.

2. Description of the Related Art

The known antenna switches for radio telephones are normally provided with a separate lever arm which is articulated onto the mainframe and by means of which the microswitch can be switched on. In one of the known antenna switches, the position of the external antenna is conveyed to the first lever arm by means of a nonconducting ball so that a bulge or the like, mounted on the upper part of the external antenna, touches the ball, when the antenna is pushed in, and pushes the ball inwards into the casing and simultaneously turning the lever arm. The other end of the lever arm is connected to the switch arm of the microswitch, which, at the same time as the lever arm is turned, is pressed down and simultaneously presses the press switch and so accomplishes the switching-on of the microswitch and connection of the signal route with the internal antenna. This kind of antenna switch has a complicated structure comprising a multitude of separate parts and therefore it is liable to malfunction. Additionally, in the known solutions, changeover over from the internal antenna to the external antenna does not take place until the antenna is pushed completely in or nearly so. This means that the external antenna functions as the antenna also during the time the antenna is pushed in or pulled out.

SUMMARY OF THE INVENTION

The objective of the invention is to obtain an antenna switch whose structure is as simple as possible and therefore reliable. The second objective of the invention is to obtain an antenna switch which minimizes the power consumption. These objectives are obtained by means of the antenna switch according to the invention which is characterized in that the switch arm is in direct contact with the external antenna so that the contact accomplishes the switching-on of the microswitch, when the external antenna is in a partly pushed-in position, and that the switch arm is situated in close vicinity to the lowest part of the external antenna when the external antenna is in its extended extreme position.

In the antenna switch according to the invention, the position of the external antenna is conveyed to the press switch of the microswitch by means of a single part i.e. the switch arm of the microswitch. The extendible external antenna is in direct contact with the switch arm and so the antenna switch has a structure which is the simplest possible and, at the same time, reliable. Since the switch arm is situated in the vicinity to the lowest part of the external antenna, when the external antenna is in an extended extreme position, the desired operation is obtained wherein the microswitch is immediately switched on as the external antenna is pushed in and, in a respective manner, the switching-on of the microswitch is not released until the external antenna is in an extended extreme position. Thus, the external antenna is not in operation during the times when the antenna is pushed in or pulled out and therefore the power consumption of the radio telephone is minimized.

BRIEF DESCRIPTION OF THE DRAWINGS

The structure and operation of an antenna switch according to one embodiment of the invention is described in greater detail in the following referring to the enclosed drawings, in which.

DETAILED DESCRIPTION OF THE PREFERRED EMBODIMENT

Figure 1:
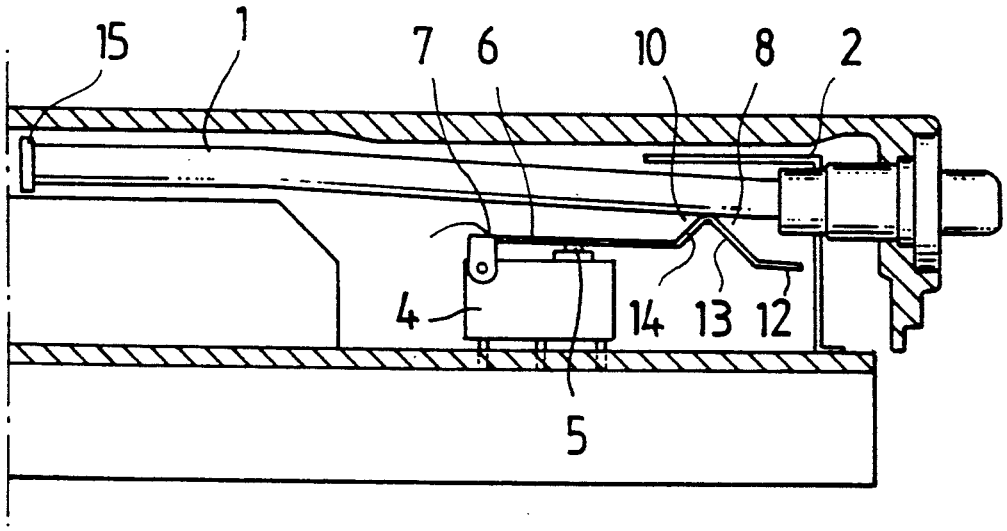
FIG. 1 shows the antenna switch when the external antenna is in a pushed-in position and FIG. 2 shows the antenna switch when the external antenna is in an extended extreme position.
Figure 2:
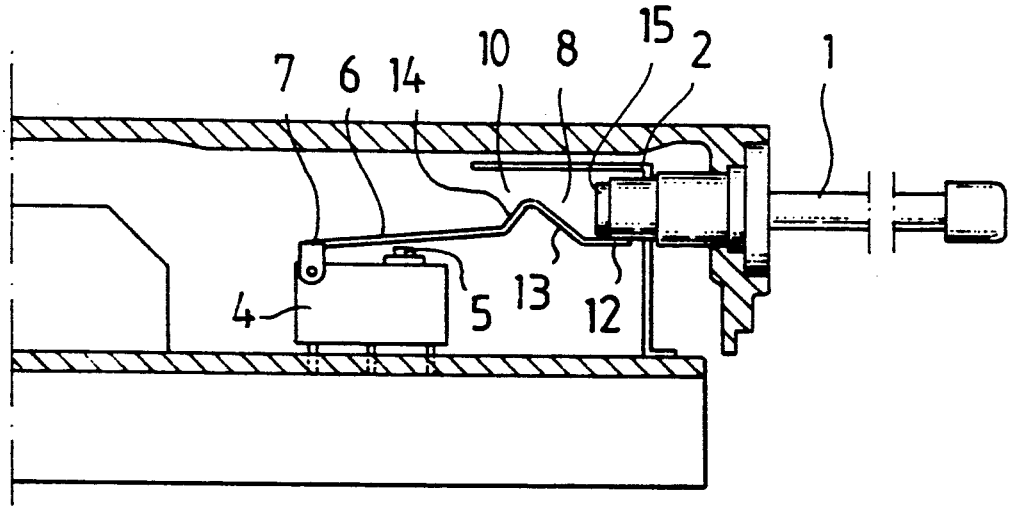

FIGS. 1 and 2 show an antenna switch according to the invention mounted on a radio telephone. The radio telephone is provided with an extendible external antenna 1 and a built-in internal antenna 2. The purpose of the antenna switch is, in the first switch position, to connect the signal route with the external antenna i.e. connect the external antenna to function as the antenna of the radio telephone and, in the second switch position, to connect with the internal antenna i.e. connect the internal antenna to function as the antenna of the radio telephone. The antenna switch is composed of a microswitch 4, mounted on the mainframe or on the pc-board, a press switch 5 of the microswitch and a switch arm 6. The microswitch 4 is switched on when the switch arm 6 is pressed down whereupon the switch arm, in a pressed-down position, simultaneously presses the press switch 5 down. In this position, the signal route is connected with the internal antenna 2. In a respective manner, when the switch arm 6 and the press switch 5 are up, the signal route is connected with the external antenna 1.

The switch arm 6 is an elongated and planar form piece which is attached to the microswitch 4 at its first end portion 7. The switch arm 6 is in contact with the external antenna 1 at its second end portion 8, when the external antenna is partly pushed in. When the external antenna 1 is fully extended, the end portion 8 is situated in the vicinity to the lowest part 15 of the external antenna. The switch arm 6 can be in contact with the press switch 5 within the middle portion of the switch arm 6 between the end portions 7 and 8, but it is also possible that the contact with the press switch 5 takes place at the end portion 8.

It can be seen in FIGS. 1 and 2 that the switch arm comprises a V-formed part 10 which is formed within the second end portion 8 and which is parallel to the longitudinal direction of the switch arm 6 and which has essentially a shape of a V in the cross-sectional plane that is perpendicular to the plane of the switch arm 6. When the external antenna 1 is partly pushed in, the switch arm 6 is in contact with the external antenna through the V-formed part 10, preferably through the edge of the V, as shown in FIG. 1. The V-formed part 10 of the switch arm 6 guarantees that the switch arm 6 bends enough to switch the microswitch 4 on. It is important for the sake of operation of the antenna switch that the first side 13 of the V-formed part 10, composed of two inclined sides 13 and 14, is suitably inclined relative to the external antenna 1. When the external antenna 1 is pushed inwards from a fully extended position, the lowest part 15 of the external antenna pushes against the first side 13 causing the switch arm 6 to turn or bend downwards so that the press switch 5 is pressed down and switches the microswitch 4 on. When the external antenna 1 is in its extended extreme position, the first side 13 is situated on the path of the external antenna 1. As shown is in FIGS. 1 and 2, the edge part 12 of the switch arm 6, which forms an extension to the V-formed part 10, is arranged to abut the rigid part of the antenna, attached to the mainframe, when the external antenna 1 is in the extended extreme position. This edge part 12 is preferably parallel with the longitudinal direction of the switch arm 6.

The switch arm 6 is essentially parallel with the axis of the external antenna 1. However, it is also possible to place the antenna switch so that the switch arm 6 and the axis of the external antenna 1 are situated on the same plane but at an angle with each other or even so that they are not situated on the same plane. The switch arm 6 can be flexible and rigidly attached to the microswitch 4 so that releasing of the switch arm 6 from its pressed-down position is at least partly effected by the elastic forces of the switch arm. On the other hand, the switch arm 6 can be pivotally attached to the microswitch 4 so that releasing of the switch arm 6 from its pressed-down position is at least partly effected by an external force acting on the switch arm 6 like e.g. the spring force of the release spring of the press switch 5.

The different operational phases of the antenna switch of FIGS. 1 and 2 will be described in the following. At the beginning, the external antenna 1 is pushed in inside the casing of the radio telephone. This means that the switch arm 6 is in contact with the external antenna 1 via the edge of the V-formed part 10 and the switch arm 6 is turned downwards so that the press switch 5 is in a pressed-down position. Hence, the microswitch 4 is switched on and the signal route is connected with the internal antenna 2. When the pulling-out of external antenna is started, position of the switch arm 6 remains unchanged until the lowest part 15 of the external antenna 1 passes by the edge of the V-formed part 10. The switch arm 6 is thereafter able to rise at the same time as the lowest part 15 of the external antenna withdraws outwards along the side 13. When the switch arm 6 and, simultaneously, the press switch 5 has risen enough, the press switch 5 releases the switching-on of the microswitch 4. At this point, the changeover from the internal antenna 2 to the external antenna 1 occurs. Almost immediately after this, while the lowest part 15 of the external antenna 1 continues its withdrawal along the first side 13, the lowest part 15 comes loose from the contact with the switch arm 6. This takes place at the same time as the edge part 12 of the switch arm 6 encounters the mainframe. After this, the switch arm 6 is not able to rise any higher. The microswitch 4 is so placed that the direct contact comes loose immediately before the external antenna 1 reaches the extended extreme position. The operation of the antenna switch, when the external antenna 1 is pushed in, contains the same phases in the reverse order and performed in the reverse direction.

The invention is not limited to the described embodiment but it can be varied within the limits of the enclosed claims.

What is claimed is:

1. An antenna switch for a radio telephone including a casing, a built-in internal antenna located in the casing and an extendable rod-type external antenna having an inner end position, in which it is substantially located within the casing, and an outer end position in which it extends substantially outside the casing, said antenna switch comprising:

a microswitch located within the casing and having a switch-on position in which a signal route is connected with an internal antenna, and a switch-off position in which the signal route is connected with the external antenna;

a press switch operatively connected with said microswitch and having a first position in which it retains said microswitch in said switch-on position, and a second position in which said microswitch is in said switch-off position; and a resilient switch arm located in said housing and engageable with said press switch, said resilient switch arm being in sliding contact with said external antenna such that it causes said press switch to be retained in said first position while the external antenna is in the inner end position and substantially during movement of the external antenna away from its inner end position, and said resilient switch arm causing said press switch to be released into said second position when said external antenna is in its outer end position.

2. An antenna switch according to claim 1 wherein said resilient switch arm comprises an elongated member having a first end position attached to said microswitch, and a second end portion in sliding engagement with an inner end of the external antenna when said external antenna is in the outer end position.

3. An antenna switch according to claim 2 wherein said elongate member is planar.

4. An antenna switch according to claim 2 wherein said first end portion is pivotally attached to said microswitch.

5. An antenna switch according to claim 2 wherein said elongate member extends substantially parallel to the external antenna and has an inverted V-shaped portion extending transverse to the longitudinal extent of said switch arm.

6. An antenna switch according to claim 5 wherein said inverted V-shaped portion has a first side located in the path of movement of the external antenna from its outer end position to its inner end position and engageable by the inner end of the external antenna when the external antenna moves from its outer end position.

7. An antenna switch according to claim 5 wherein said second end portion extends substantially parallel to the external antenna and is formed as an extension of said inverted V-portion.

8. An antenna switch according to claim 1 wherein said resilient switch arm comprises an elongated member having a first end portion attached to said microswitch and a second end portion which is located in close proximity to an inner end of the external antenna when the external antenna is in the outer end position.

9. An antenna switch according to claim 8 wherein said elongate member is planar.

10. An antenna switch according to claim 8 wherein said first end portion is pivotally attached to said microswitch.

11. An antenna switch according to claim 8 wherein said elongate member extends substantially parallel to the external antenna and has an inverted V-shaped portion extending transverse to the longitudinal extent of said switch arm.

12. An antenna switch according to claim 11 wherein said inverted V-shaped portion has a first side located in the path of movement of the external antenna from its outer end position to its inner end position and engageable by the inner end of the external antenna when the external antenna moves from its outer end position.

13. An antenna switch according to claim 11 wherein said second end portion extends substantially parallel to the external antenna and is formed as an extension of said inverted V-portion.

* * * * *